US012181215B2

(12) United States Patent
Higginbotham et al.

(10) Patent No.: US 12,181,215 B2
(45) Date of Patent: Dec. 31, 2024

(54) HYDROGEN LIQUEFIER

(71) Applicant: Air Products and Chemicals, Inc., Allentown, PA (US)

(72) Inventors: Paul Higginbotham, Guildford (GB); John H. Petrik, Bethlehem, PA (US); Christopher F. Harris, Zionsville, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 319 days.

(21) Appl. No.: 17/542,682

(22) Filed: Dec. 6, 2021

(65) Prior Publication Data

US 2023/0175773 A1 Jun. 8, 2023

(51) Int. Cl.
*F25J 1/02* (2006.01)
*F25J 1/00* (2006.01)

(52) U.S. Cl.
CPC ..... *F25J 1/0052* (2013.01); *F25J 1/0007* (2013.01); *F25J 1/001* (2013.01); *F25J 1/0015* (2013.01); *F25J 1/0067* (2013.01); *F25J 1/0072* (2013.01); *F25J 1/0214* (2013.01); *F25J 2270/16* (2013.01)

(58) Field of Classification Search
CPC .. F25J 1/001; F25J 1/0037; F25J 1/004; F25J 1/0067; F25J 1/0072; F25J 1/005; F25J 1/0045; F25J 1/0208; F25J 1/0052; F25J 2270/16; F25J 2270/06; F25J 1/0007
See application file for complete search history.

(56) References Cited

U.S. PATENT DOCUMENTS

| | | | | |
|---|---|---|---|---|
| 3,116,115 | A | 12/1963 | Kasparian et al. | |
| 3,375,076 | A * | 3/1968 | Vander Arend | F25B 9/004 62/613 |
| 3,380,809 | A | 4/1968 | Newton | |
| 5,579,655 | A * | 12/1996 | Grenier | F25J 1/005 62/913 |
| 2017/0038136 | A1* | 2/2017 | Turney | F25J 1/0022 |
| 2022/0390169 | A1* | 12/2022 | Heyrman | F25J 1/0072 |
| 2023/0147955 | A1* | 5/2023 | Schwartz | F25J 1/0052 62/607 |

FOREIGN PATENT DOCUMENTS

| | | | |
|---|---|---|---|
| GB | 1001938 | A | 8/1965 |
| JP | H05280860 | A | 10/1993 |
| JP | 2004210597 | A | 7/2004 |

OTHER PUBLICATIONS

International Search Report; PCT/1B2022/057094, 9 pgs.
(Continued)

*Primary Examiner* — John F Pettitt, III
(74) *Attorney, Agent, or Firm* — Jason M. Ploeger

(57) ABSTRACT

Hydrogen is liquefied through a process utilizing refrigeration from hydrogen at one, two, or three different pressures as well as a nitrogen refrigeration cycle. One or more stages of catalyst are used to convert ortho-hydrogen to para-hydrogen as the hydrogen is cooled and liquefied. Subcooled liquid hydrogen feeds the final stage of ortho-hydrogen to para-hydrogen conversion to reduce or eliminate vaporization of the hydrogen during the exothermic ortho-hydrogen to para-hydrogen conversion.

16 Claims, 9 Drawing Sheets

(56) References Cited

OTHER PUBLICATIONS

Essler, Jurgen et al; "Report on technology overview and barriers to energy-and cost-efficient large-scale hydrogen liquefaction", Jun. 4, 2012; 82 pgs.
Gursu, S. et al; "An Optimization Study of Liquid Hydrogen Boil-off Losses", Nov. 26, 1991; 10 pgs.; Int. Hydrogen Energy, vol. 17, No. 3, pp. 227-236; Pergamon Press, Ltd, GB.
Ohira, K.; "A Summary of Liquid Hydrogen and Cryogenic Technologies in Japan's WE-NET Project", 8 pgs., 2004; CP710, Advances in Cryogenic Engineering: Transactions of the Cryogenic Engineering Conference-CEC, vol. 49.

* cited by examiner

HYDROGEN LIQUEFIER

BACKGROUND

Hydrogen liquefiers have been around for a long time, with a great deal of development taking place in support of the space program in the second half of the twentieth century. However, the largest existing hydrogen liquefiers have a capacity of about 30 tonne/day, and, in the future, larger liquefiers are likely to be needed in support of the hydrogen economy. Several studies such as Essler et al. ("Report on technology overview and barriers to energy- and cost-efficient large-scale hydrogen liquefiers", Fuel Cells and Hydrogen Joint Undertaking, 2012) have been published that explore more cost-effective hydrogen liquefier designs to reduce power consumption and capital cost.

Typically, the hydrogen liquefaction process may include the steps of warm refrigeration, feed purification, cold refrigeration, ortho-para conversion, pressure reduction and storage. Within the prior art, there are numerous ways to configure each of these steps. Warm refrigeration typically uses liquid nitrogen or a refrigeration cycle with a working fluid like nitrogen or mixed refrigerant. There are several variants of the cold refrigeration cycle, which are independent of the other parts of the liquefier process.

In some configurations, the feed hydrogen is kept entirely separate from a closed-loop cold refrigeration system, which may be a hydrogen cycle (using normal- or para-hydrogen) or use some other component such as helium or neon or a mixture. The cooled feed hydrogen is subcooled prior to storage so that there is very little flash vapor, and boil-off from storage is typically recompressed (for example in an ejector) and recondensed by the cold refrigeration cycle.

In other configurations, part of the normal-hydrogen feed is used for the refrigeration cycle and recycled back to the feed to provide cold refrigeration in an open loop.

In yet further configurations, para-hydrogen is recycled independently of the feed and used in the cold refrigeration cycle. Make-up to the refrigeration cycle is provided from flash gas at the cold end of the process, and part of the condensed recycle provides part of the liquid product.

Within the refrigeration cycle, different numbers of expanders may be arranged in series or parallel or a combination of both, and cooling may or may not be present between expanders in series. Turboexpanders are preferred for their reliability and low maintenance despite their limited expansion ratio with hydrogen, but expansion engines may also be used. Ortho-para conversion of the feed (and recycle) may take place continuously in the heat exchanger or in a series of adiabatic conversion reactors operating at different temperatures.

The need for ortho-para conversion in liquid hydrogen production is explained in Gursu et al. ("An Optimization Study of Liquid Hydrogen Boil-Off Losses", Int. J. Hydrogen Energy, 17:3 227-236, 1992) Hydrogen occurs as one of two different isomers: an ortho species with the nuclear spins of the protons in the same direction; and a para species with the nuclear spins in the opposite direction. At higher temperatures the equilibrium mixture is 75% ortho-hydrogen (also known as normal hydrogen), but as temperatures approach 0 K the equilibrium mixture approaches 100% para-hydrogen. The conversion of ortho-hydrogen to para-hydrogen is exothermic, so liquid hydrogen with 75% ortho-hydrogen will gradually convert to para-hydrogen and the heat produced will boil off almost 70% of the liquid hydrogen. To reduce this risk, liquid hydrogen is typically given a product specification of a minimum percentage of para-hydrogen to reduce boil-off.

Ohira ("A Summary of Liquid Hydrogen and Cryogenic Technologies in Japan's WE-NET Project", AIP Conference Proceedings, 710:27, 2004) describes a process suitable for a large-scale hydrogen liquefier that includes a hydrogen closed loop cold refrigeration system. Newton (U.S. Pat. No. 3,380,809) describes a process where para-hydrogen is recirculated to provide the cold refrigeration.

There exists a need for a large-scale hydrogen liquefier with a cold refrigeration cycle that addresses and/or improves at least some of the above-mentioned disadvantages of existing hydrogen liquefaction systems.

SUMMARY

In at least some implementations, the present disclosure relates to improvements in the cold refrigeration cycle and preferably for uses that are especially applicable to large-scale hydrogen liquefiers.

In small scale liquefiers, it is advantageous to have relatively low pressures in the hydrogen recycle loop to keep volumetric flows higher to improve machinery (compressor and expander) efficiencies, despite the higher pressure drop losses in the heat exchangers. As the scale is increased, it is beneficial to the process efficiency to increase pressures in the hydrogen recycle loop and reduce volumetric flows. At large scale, the capacities of available compressors are exceeded. For the low-pressure hydrogen recycle loops currently practiced, higher volumetric flows entering the compressors results in more compressors than the embodiments shown in the present disclosure.

The critical point of hydrogen is about 13 bar and 33 K; for large-scale liquefiers it is desirable to set the discharge pressure of the expanders close to this 13 bar pressure but remain below the critical pressure. However, increasing the pressure increases the minimum temperature that can be achieved by the expander cooling, because the saturation temperature of the gas leaving the coldest expander increases.

Cooling below the cold expander discharge temperature has to be by evaporation of part of the liquid hydrogen at lower pressure (typically close to atmospheric pressure). As the main recycle return pressure (and therefore the temperature) is increased, this process becomes less efficient because of the increasing amount of hydrogen that needs to be boiled at low pressure and compressed into the suction of the recycle compressor. The size and cost of the low-pressure hydrogen compressor is also increased as its flow is increased.

In addition, in at least some implementations of the presented disclosure, there is provided a means to improve the efficiency and reduce the cost of a hydrogen liquefier process with a higher pressure recycle return by introducing an intermediate pressure return between the low pressure hydrogen product and the medium pressure of the final expander exhaust. The low-pressure compressor is then split into two sections and the suction volumetric flow is reduced. The intermediate pressure return stream may be flash gas from a pressure reduction of the liquid hydrogen, or evaporated liquid hydrogen, or a combination of both. Significant power savings can be achieved from utilizing hydrogen at three pressures compared to one or two.

Aspect 1: A process for liquefying hydrogen, the process comprising cooling a hydrogen feed comprising ortho-hydrogen and para-hydrogen by indirect heat exchange to form a cold hydrogen stream; expanding at least a portion of the cold hydrogen stream to produce a partially vaporized intermediate-pressure hydrogen stream; separating the partially vaporized intermediate-pressure hydrogen stream to produce an intermediate-pressure hydrogen vapor stream and an intermediate-pressure hydrogen liquid stream; expanding at least a portion of the intermediate-pressure hydrogen liquid stream to produce a partially vaporized low-pressure hydrogen stream; warming by indirect heat exchange the partially vaporized low-pressure hydrogen stream or a stream derived from the partially vaporized low-pressure hydrogen stream to produce a warmed low-pressure hydrogen stream; warming by indirect heat exchange the intermediate-pressure hydrogen vapor stream to produce a warmed intermediate-pressure hydrogen stream; compressing and combining the warmed low-pressure hydrogen stream, the warmed intermediate-pressure hydrogen stream, and a warmed medium-pressure hydrogen stream to produce a recycle stream; cooling by indirect heat exchange the recycle stream to produce a cooled recycle stream; expanding at least a portion of the cooled recycle stream to produce a first cold medium-pressure hydrogen stream; and warming by indirect heat exchange the first cold medium-pressure hydrogen stream to produce the warmed medium-pressure hydrogen stream; wherein the cooling duty for cooling the hydrogen feed by indirect heat exchange is provided at least in part by the intermediate-pressure hydrogen vapor stream.

Aspect 2: A process according to Aspect 1, further comprising catalytically converting at least a portion of the ortho-hydrogen into para-hydrogen in the cold hydrogen stream.

Aspect 3: A process according to Aspect 2, wherein the pressure of the cold hydrogen stream is above the critical pressure and the temperature of the cold hydrogen stream is below the critical temperature.

Aspect 4: A process according to any of Aspects 1 to 3, further comprising warming by indirect heat exchange at least a portion of the intermediate-pressure hydrogen liquid stream to produce a second warmed intermediate-pressure hydrogen stream; and compressing and combining the second warmed intermediate-pressure hydrogen stream with the warmed low-pressure hydrogen stream, the warmed intermediate-pressure hydrogen stream, and a warmed medium-pressure hydrogen stream to produce the recycle stream.

Aspect 5: A process according to any of Aspects 1 to 4, further comprising dividing a portion of the intermediate-pressure hydrogen vapor stream and/or the warmed intermediate-pressure hydrogen stream to produce a purge gas stream; wherein the hydrogen feed and the purge gas stream comprise one or more light gases selected from a group consisting of helium and neon; and wherein the purge gas stream is enriched in light gases relative to the hydrogen feed.

Aspect 6: A process according to any of Aspects 1 to 5, further comprising catalytically converting at least a portion of the ortho-hydrogen into para-hydrogen in the cooled recycle stream.

Aspect 7: A process according to any of Aspects 1 to 6, further comprising separating the hydrogen feed while cooling to form a cold hydrogen stream enriched in hydrogen relative to the hydrogen feed and a waste stream depleted in hydrogen relative to the hydrogen feed.

Aspect 8: A process according to any of Aspects 1 to 7, further comprising expanding at least a portion of the cold hydrogen stream to produce a second medium-pressure hydrogen stream; and warming by indirect heat exchange and combining the second medium-pressure hydrogen stream and the first cold medium-pressure hydrogen stream to produce the warmed medium-pressure hydrogen stream.

Aspect 9: A process according to any of Aspects 1 to 8, further comprising expanding at least a portion of the cooled recycle stream to produce a cold recycle stream; and combining the cold recycle stream with the cold hydrogen stream.

Aspect 10: A process according to any of Aspects 1 to 9, wherein the recycle stream comprises more than 90% para-hydrogen by volume.

Aspect 11: A process according to any of Aspects 1 to 10, further comprising compressing at least a portion of a nitrogen stream by one or more stages of compression to produce a compressed nitrogen stream; cooling by indirect heat exchange the compressed nitrogen stream to produce a cooled compressed nitrogen stream; expanding at least a portion of the cooled compressed nitrogen stream to produce a partially condensed nitrogen stream; separating the partially condensed nitrogen stream to produce a nitrogen vapor stream and a nitrogen liquid stream; and warming by indirect heat exchange and combining the nitrogen vapor stream and at least a portion of the nitrogen liquid stream to produce a nitrogen return stream; wherein the nitrogen stream comprises the nitrogen return stream; wherein the cooling duty for cooling the hydrogen feed by indirect heat exchange is provided at least in part by the nitrogen vapor stream and the at least a portion of the nitrogen liquid stream.

Aspect 12: A process according to Aspect 11, further comprising dividing at least a portion of the nitrogen liquid stream to produce a liquid nitrogen product.

Aspect 13: A process according to Aspect 11 or Aspect 12, further comprising cooling by indirect heat exchange and dividing a portion of the compressed nitrogen stream to produce a cold nitrogen expander feed; expanding the cold nitrogen expander feed to produce a first cold medium-pressure nitrogen stream; warming by indirect heat exchange the first cold medium-pressure nitrogen stream to produce a first medium-pressure nitrogen stream; and feeding a medium-pressure nitrogen recycle stream to an interstage of the one or more stages of compression; wherein the medium-pressure nitrogen recycle stream comprises the first medium-pressure nitrogen stream.

Aspect 14: A process according to Aspect 13, further comprising extracting a portion of the nitrogen stream from an interstage of the one or more stages of compression to produce a warm nitrogen expander feed; expanding the warm nitrogen expander feed to produce a second cold medium-pressure nitrogen stream; and warming by indirect heat exchange the second cold medium-pressure nitrogen stream to produce a second medium-pressure nitrogen recycle stream; wherein the medium-pressure nitrogen recycle stream comprises the second medium-pressure nitrogen recycle stream.

Aspect 15: A process according to Aspect 14, further comprising expanding at least a portion of the cooled compressed nitrogen stream to produce a third cold medium-pressure nitrogen stream; warming by indirect heat exchange the third cold medium-pressure nitrogen stream to produce a third medium-pressure nitrogen recycle stream; wherein the medium-pressure nitrogen recycle stream comprises the third medium-pressure nitrogen recycle stream.

Aspect 16: A process according to any of Aspects 1 to 15, further comprising separating the partially vaporized low-pressure hydrogen stream to produce a low-pressure hydrogen vapor stream and a low-pressure hydrogen liquid stream; dividing at least a portion of the low-pressure hydrogen liquid stream to form a low-pressure hydrogen return stream; warming by indirect heat exchange and combining the low-pressure hydrogen return stream with the low-pressure hydrogen vapor stream to produce the warmed low-pressure hydrogen stream.

Aspect 17: A process according to any of Aspects 1 to 16, further comprising catalytically converting at least a portion of the ortho-hydrogen into para-hydrogen in the hydrogen feed.

Aspect 18: A process for converting ortho-hydrogen to para-hydrogen in a hydrogen feed, the process comprising cooling the hydrogen feed comprising ortho-hydrogen and para-hydrogen by indirect heat exchange to form a cold hydrogen stream; wherein the pressure of the cold hydrogen stream is above the critical pressure and the temperature of the cold hydrogen stream is below the critical temperature; catalytically converting at least a portion of the ortho-hydrogen into para-hydrogen in the cold hydrogen stream to produce a para-hydrogen-enriched cold hydrogen stream; wherein the pressure of the para-hydrogen-enriched cold hydrogen stream is above the critical pressure and the temperature of the para-hydrogen-enriched cold hydrogen stream is below the critical temperature.

BRIEF DESCRIPTION OF THE DRAWINGS

The present disclosure will hereinafter be described in conjunction with the appended figures wherein like numerals denote like elements.

DETAILED DESCRIPTION

Figure 1A:
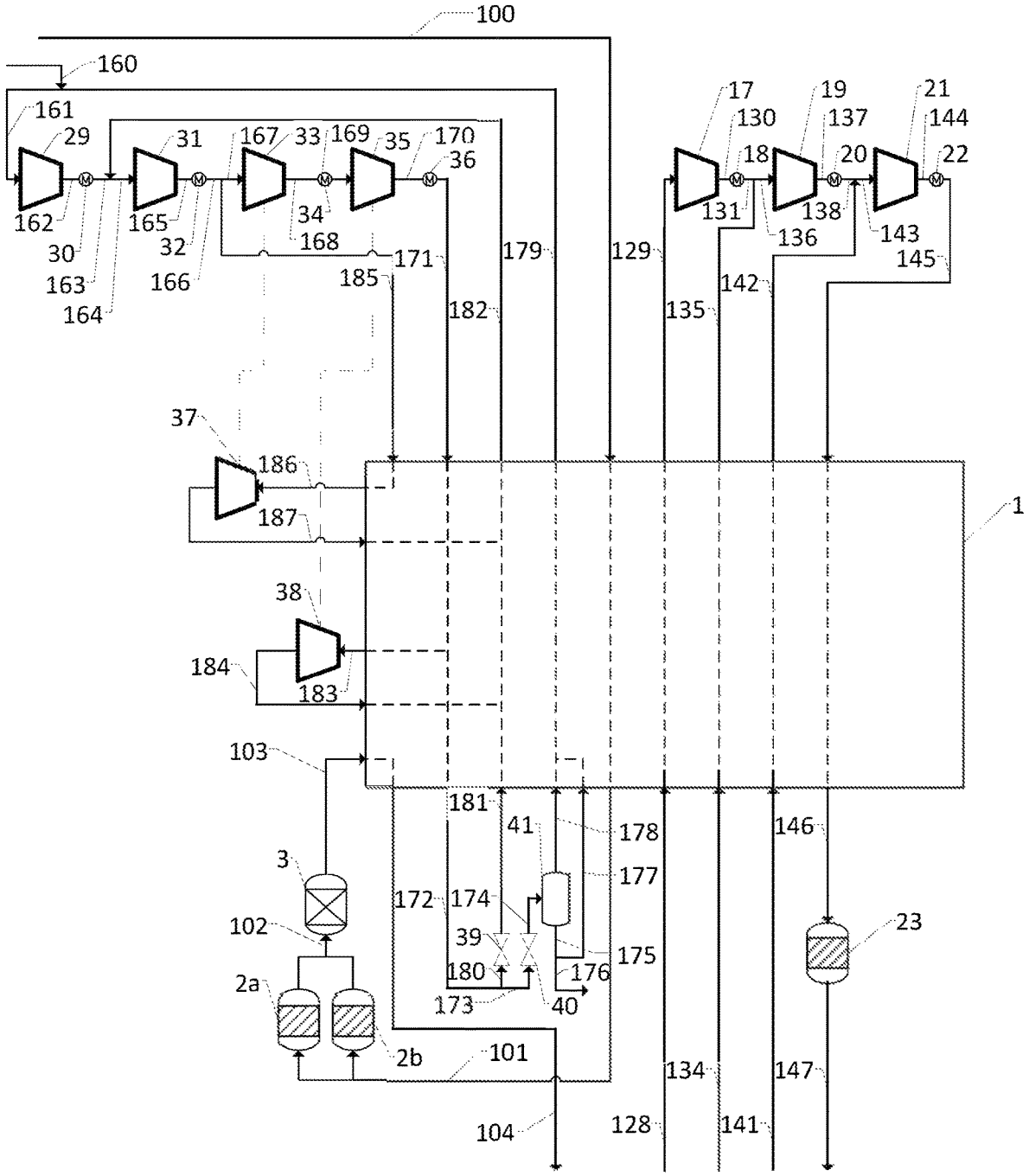
FIG. 1A is a flowsheet depicting the warm end of a hydrogen liquefaction process according to an example embodiment of the present disclosure.

The ensuing detailed description provides preferred exemplary embodiments only, and is not intended to limit the scope, applicability, or configuration of the invention. Rather, the ensuing detailed description of the preferred exemplary embodiments will provide those skilled in the art with an enabling description for implementing the preferred exemplary embodiments of the invention. Various changes may be made in the function and arrangement of elements without departing from the spirit and scope of the invention, as set forth in the appended claims.

The articles "a" or "an" as used herein mean one or more when applied to any feature in embodiments of the present invention described in the specification and claims. The use of "a" and "an" does not limit the meaning to a single feature unless such a limit is specifically stated. The article "the" preceding singular or plural nouns or noun phrases denotes a particular specified feature or particular specified features and may have a singular or plural connotation depending upon the context in which it is used.

The term "and/or" placed between a first entity and a second entity includes any of the meanings of (1) only the first entity, (2) only the second entity, or (3) the first entity and the second entity. The term "and/or" placed between the last two entities of a list of 3 or more entities means at least one of the entities in the list including any specific combination of entities in this list. For example, "A, B and/or C" has the same meaning as "A and/or B and/or C" and comprises the following combinations of A, B and C: (1) only A, (2) only B, (3) only C, (4) A and B but not C, (5) A and C but not B, (6) B and C but not A, and (7) A and B and C.

The term "plurality" means "two or more than two."

The adjective "any" means one, some, or all, indiscriminately of quantity.

The phrase "at least a portion" means "a portion or all." The "at least a portion of a stream" has the same composition, with the same concentration of each of the species, as the stream from which it is derived.

As used herein, "first," "second," "third," etc. are used to distinguish among a plurality of steps and/or features, and is not indicative of the total number, or relative position in time and/or space, unless expressly stated as such.

The terms "depleted" or "lean" mean having a lesser mole percent concentration of the indicated component than the original stream from which it was formed. "Depleted" and "lean" do not mean that the stream is completely lacking the indicated component.

The terms "rich" or "enriched" mean having a greater mole percent concentration of the indicated component than the original stream from which it was formed.

The term "indirect heat exchange" refers to the process of transferring sensible heat and/or latent heat between two or more fluids without the fluids in question coming into physical contact with one another. The heat may be transferred via any number of suitable means, including through the wall of a heat exchanger or with the use of an intermediate heat transfer fluid. The term "hot stream" refers to any stream that exits the heat exchanger at a lower temperature than it entered. Conversely, a "cold stream" is one that exits the heat exchanger at a higher temperature than it entered.

FIG. 1A shows the warm end of a hydrogen liquefier process. A gaseous hydrogen feed 100 at a pressure between 15 and 100 bar, or between 20 and 30 bar, and at ambient temperature is cooled in warm heat exchanger 1 to around 80 K to produce a cooled hydrogen stream 101. All pressures cited are in absolute units. In the embodiment shown in FIG. 1A, the cooling duty in the warm heat exchanger 1 is provided by a warm nitrogen refrigeration system, but any suitable cooling fluid may be used including imported liquid nitrogen, liquid natural gas, or a mixed refrigerant.

Low pressure make-up nitrogen 160 is mixed with a nitrogen return stream 179 from the warm heat exchanger 1 to form a nitrogen stream 161 at a pressure between 0.7 and 2 bar, or between 0.7 and 1.5 bar which is compressed in a low-pressure nitrogen compressor 29 to a pressure between 4 and 16 bar, or between 6 and 12 bar, before being cooled in a first aftercooler 30 to form medium-pressure nitrogen stream 163. Medium-pressure nitrogen stream 163 is compressed in a medium-pressure nitrogen compressor 31 to a pressure between 20 and 45 bar, or between 25 and 35 bar, before being cooled in a second aftercooler 32 to form an intermediate nitrogen stream 166. At least a portion of the intermediate nitrogen stream 166 is then compressed to a pressure between 45 and 100 bar, or between 50 and 70 bar, in one or more nitrogen companders to form compressed nitrogen stream 171. In the embodiment shown in FIG. 1A first and second nitrogen companders 33 and 35 are used, followed by third and fourth aftercoolers 34 and 36, respectively. At least a portion of the compressed nitrogen stream 171 is then cooled in warm heat exchanger 1 to form cooled compressed nitrogen stream 172. At least a portion of cooled compressed nitrogen stream 172 is reduced in pressure to about 1.1 bar across a valve 40 to form a partially condensed nitrogen stream 174, which is then separated in separator 41 to produce a nitrogen vapor stream 178 and a nitrogen liquid stream 175. At least a portion of the nitrogen liquid stream 175 may be divided to form a liquid nitrogen product 176. The remaining portion of the nitrogen liquid 177 and the nitrogen vapor stream 178 are warmed in the warm heat exchanger 1 to provide refrigeration duty to cool the gaseous hydrogen feed 100. The nitrogen liquid 177 is vaporized in the warm heat exchanger 1 and may be combined with the nitrogen vapor stream 178 before, within, or after the warm heat exchanger 1 to form the nitrogen return stream 179.

A portion of compressed nitrogen stream 171 may be divided and cooled in the warm heat exchanger 1 to produce a cold nitrogen expander feed 183. The cold nitrogen expander feed 183 is reduced in pressure to match the pressure of medium-pressure nitrogen stream 163 in cold nitrogen expander 38 to form a first cold medium-pressure nitrogen stream 184.

A portion of stream 166 may be divided and cooled in warm heat exchanger 1 to form a warm nitrogen expander feed 186. The warm nitrogen expander feed 186 is reduced in pressure to match the pressure of medium-pressure nitrogen stream 163 in warm nitrogen expander 37 to form a second cold medium-pressure nitrogen stream 187.

The cold nitrogen expander 38 and the warm nitrogen expander 37 may be used to produce work as turbines, which can be used to generate electrical power and/or mechanically drive compressors in the process. In FIG. 1A, cold nitrogen expander 38 drives nitrogen compander 35 and warm nitrogen expander 37 drives nitrogen compander 33.

A portion of cooled compressed nitrogen stream 172 may be divided and reduced in pressure to match the pressure of medium-pressure nitrogen stream 163 across valve 39 to form a third cold medium-pressure nitrogen stream 181.

The first cold medium-pressure nitrogen stream 184, the second cold medium-pressure nitrogen stream 187, and the third cold medium-pressure nitrogen stream 181 may be warmed in warm heat exchanger 1 and may be combined before, within, or after the warm heat exchanger 1 to form a medium-pressure nitrogen recycle stream 182. The medium-pressure nitrogen recycle stream 182 may then be combined with medium-pressure nitrogen stream 163 prior to the medium-pressure nitrogen compressor 31.

Each of the nitrogen compressors, each comprising one or more stages, may be separate machines or combined into multiple-stage machines. For example, nitrogen companders 33 and 35 may be combined into a single machine if only one of the warm nitrogen expander 37 and cold nitrogen expander 38 are used.

If necessary, residual levels of impurities such as methane, oxygen, and nitrogen may be removed from cooled hydrogen stream 101 to prevent freezing at liquid hydrogen temperatures. Impurities are typically removed by temperature swing adsorption, shown in FIG. 1A as adsorbers 2*a* and 2*b*, which may be operated such that one adsorber is removing impurities while the other adsorber is being regenerated.

The purified cooled hydrogen stream 102 may then feed an adiabatic ortho-para conversion reactor 3 in which ortho-hydrogen is exothermically converted to para-hydrogen. Hydrogen stream 103 is then recooled back to around 80K in the warm heat exchanger 1, after which cooled hydrogen stream 104 enters the cold end of the hydrogen liquefier.

Figure 1B:
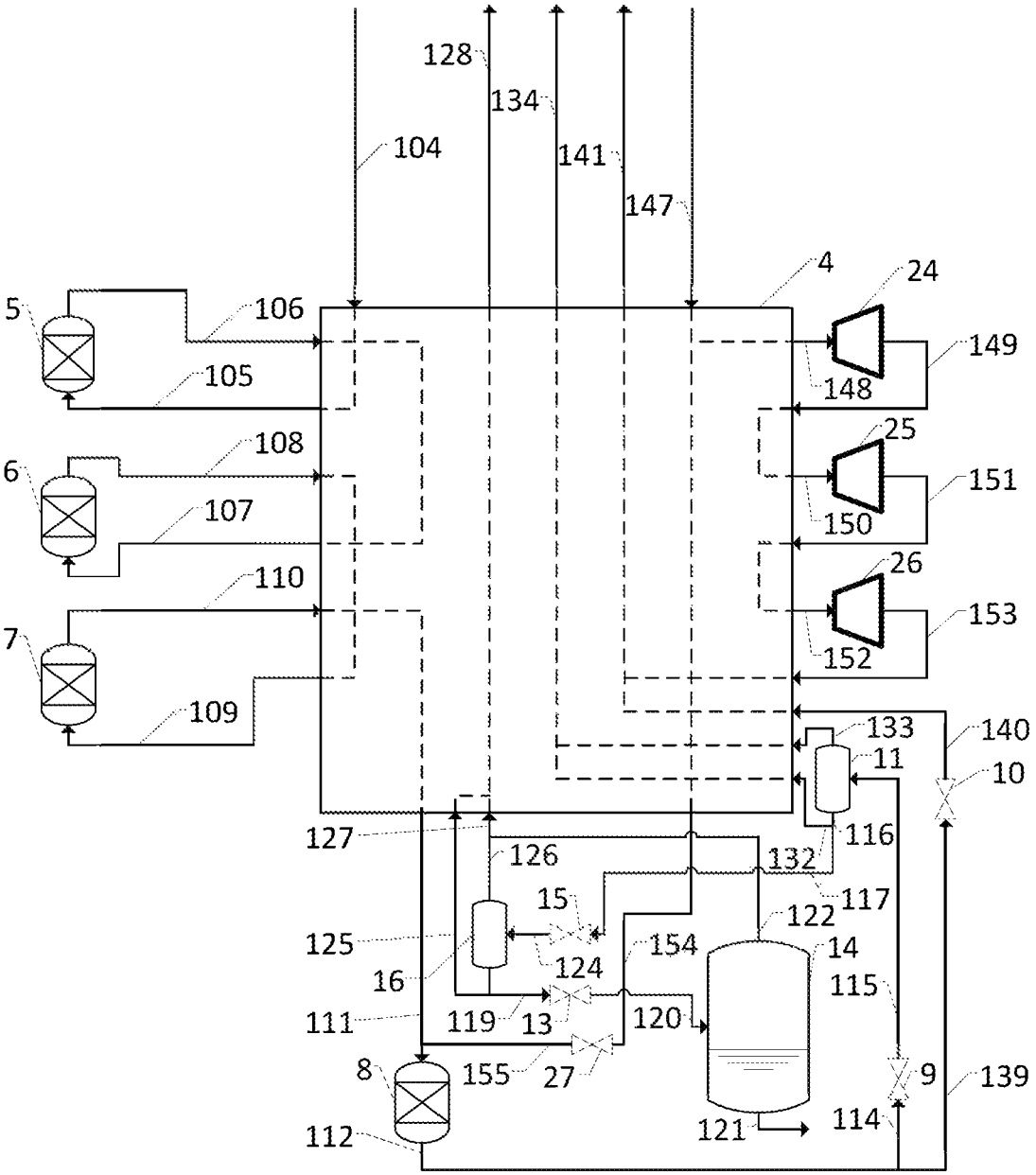
FIG. 1B is a flowsheet depicting the cold end of a hydrogen liquefaction process according to an example embodiment of the present disclosure.
Figure 1C:
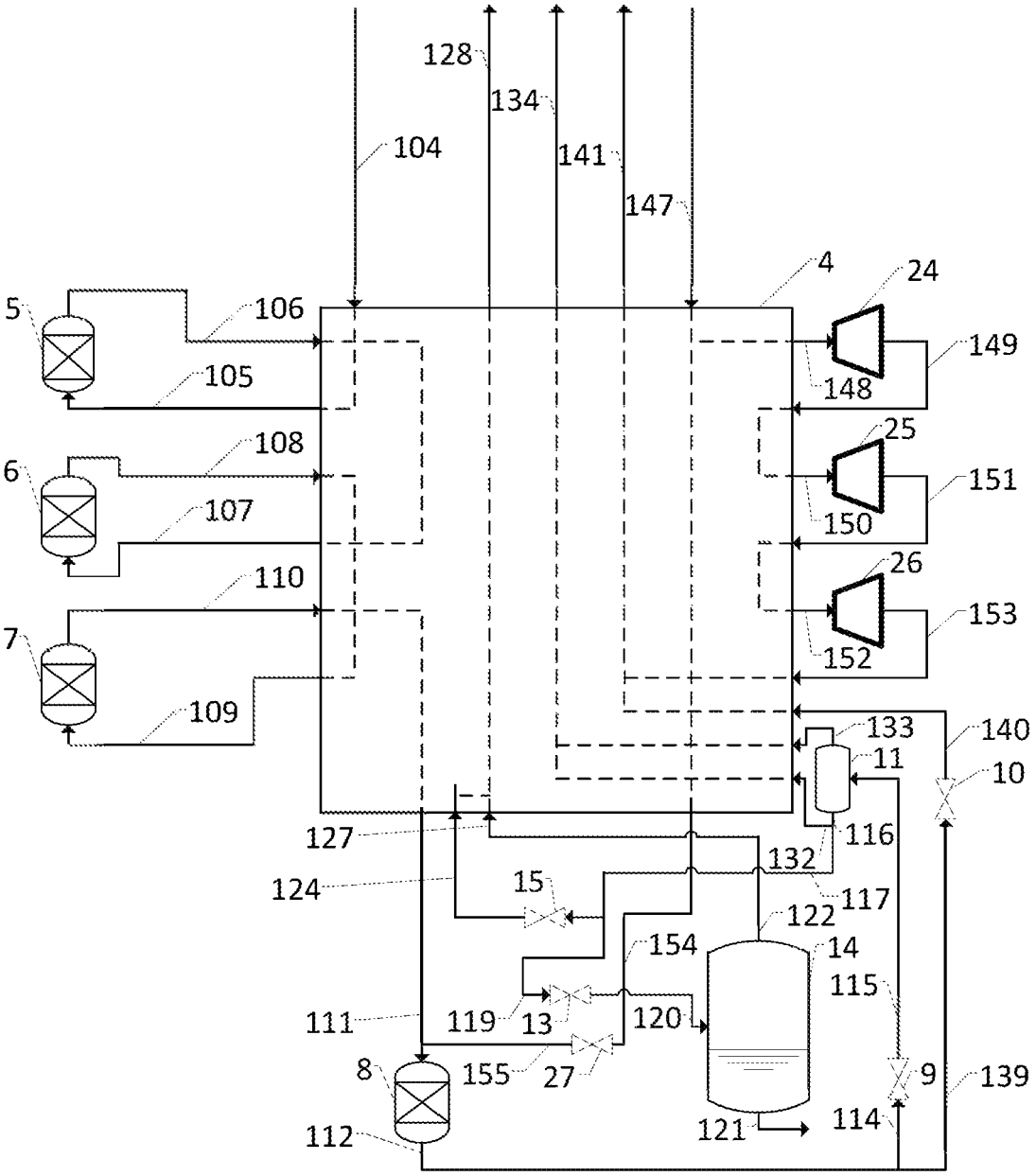
FIG. 1C is a flowsheet depicting a modification of the embodiment in FIG. 1B in which the low pressure partially vaporized hydrogen is not separated prior to reheating, according to an additional example embodiment of the present disclosure.

FIG. 1B shows an embodiment of the cold end of the hydrogen liquefier where the cooled hydrogen stream 104 is first cooled to about 25K in cold heat exchanger 4. During the process, the cooled hydrogen stream 104 may undergo one or more stages of ortho-para conversion. According to the example embodiment depicted in FIG. 1B, there are three initial stages of ortho-para conversion in three reactors: ortho-para conversion reactor 5, ortho-para conversion reactor 6, and ortho-para conversion reactor 7. Each successive ortho-para conversion reactor operates at a lower temperature, shifting the equilibrium towards para-hydrogen and increasing the amount of conversion possible. The product of each ortho-para conversion reaction is returned to the cold heat exchanger 4 closer to the warm end than the feed was withdrawn because of the exothermic reaction reheating the hydrogen stream. Cold hydrogen stream 111 leaves the cold heat exchanger 4 at around 25K and enters a cold ortho-para conversion reactor 8. The cold hydrogen stream 111 is a subcooled liquid with a temperature below the critical temperature and a pressure above the critical pressure. Operating at a higher pressure allows the cold ortho-para conversion reactor 8 to operate at a higher temperature without the risk of vapor formation that may damage the catalyst. In the prior art the final ortho-para conversion reactor is typically operated near the boiling point of hydrogen, at a lower temperature which offers higher conversion to para-hydrogen. However, this approach typically produces a liquid hydrogen product with a para-hydrogen fraction higher than product specifications require. In accordance with at least some embodiments of the disclosure, the disclosed systems and processes allow the temperature, and therefore para-hydrogen fraction, to be controlled closer to the product specifications and minimize unnecessary exothermic reaction, which in turn lowers the overall process power demand compared to existing hydrogen liquefiers.

Para-hydrogen-enriched cold hydrogen stream 112 leaves the cold ortho-para conversion reactor 8, and may be divided into two or more portions. According to an example embodiment depicted in FIG. 1B, the two portions are a first cold hydrogen fraction 114 and a second cold hydrogen fraction 139. The first cold hydrogen fraction 114 is reduced in pressure to between 2 and 8 bar to form a partially vaporized intermediate-pressure hydrogen stream 115 which in turn is separated into an intermediate-pressure hydrogen vapor stream 133 and an intermediate-pressure hydrogen liquid stream 116 in intermediate-pressure separator 11. The intermediate-pressure separator 11 may be any vessel or column that may effect a phase separation. The intermediate-pressure hydrogen vapor stream 133 is heated in cold heat exchanger 4. At least a portion of the intermediate-pressure hydrogen liquid stream 132 may be reheated in cold heat exchanger 4 either in a separate heat exchanger path or after being mixed with intermediate-pressure hydrogen vapor stream 133, to produce a partially reheated intermediate-pressure hydrogen stream 134.

At least a portion of the intermediate-pressure hydrogen liquid stream 116 is reduced to a pressure between 0.7 and 2 bar, or between 0.7 and 1.5 bar, to form a partially vaporized low-pressure hydrogen stream 124 which in turn may be separated into a low-pressure hydrogen vapor stream 126 and a low-pressure hydrogen liquid stream 119 in low-pressure separator 16. The low-pressure separator 16 may be any vessel or column that may effect a phase separation. The low-pressure hydrogen liquid stream 119 enters via flow control valve 13 into a storage tank 14 where a liquid hydrogen product 121 can be withdrawn. Boiloff vapor 122 from the storage tank 14 may be combined with the low-pressure hydrogen vapor stream 126. A portion of low-pressure hydrogen liquid stream 119 may be divided to form low-pressure liquid hydrogen return stream 125 which is heated along with low-pressure hydrogen vapor stream 126 in cold heat exchanger 4. The low-pressure hydrogen return stream 125 may be used to subcool the cold hydrogen stream 111 if needed in cold heat exchanger 4 either in a separate heat exchanger path or after being mixed with low-pressure hydrogen vapor stream 127, to produce a partially reheated low-pressure hydrogen stream 128.

The partially reheated low-pressure hydrogen stream 128 and the partially reheated intermediate-pressure hydrogen stream 134 enter the warm end of the hydrogen liquefier depicted in FIG. 1A, where they are heated in warm heat exchanger 1 to form a warmed low-pressure hydrogen stream 129 and a warmed intermediate-pressure hydrogen stream 135 respectively. The warmed low-pressure hydrogen stream 129 is compressed in a low-pressure compressor 17 to form stream 130 which then may be cooled in interstage cooler 18 to form stream 131. The warmed intermediate-pressure hydrogen stream 135 is then combined with stream 131 and compressed in an intermediate-pressure compressor 19 to form stream 137 which then may be cooled in interstage cooler 20 to form stream 138. Stream 138 is compressed in a medium-pressure compressor 21 to form stream 144 which then may be cooled in aftercooler 22 to form a recycle stream 145 at a pressure between 25 and 100 bar, or between 30 and 65 bar. The low-pressure compressor 17, the intermediate-pressure compressor 19, and the medium-pressure compressor 21 may be separate machines, each with one or more stages, or combined into a single multiple-stage machine. The recycle stream 145 is then cooled in warm heat exchanger 1 to form cooled recycle stream 146 which then may be purified in a guard adsorber bed 23 to form stream 147, which then returns to the cold end of the hydrogen liquefier.

If the feed contains small amounts of light gases such as helium and neon that are difficult to remove via adsorption, in at least some example implementations, the process may require a purge stream (not shown). The purge stream may be provided by dividing a portion of the intermediate-pressure hydrogen vapor stream 133 and/or the warmed intermediate-pressure hydrogen stream 135. The purge stream may be sourced from the overhead of intermediate-pressure separator 11 so that it will be enriched in light gases relative to the gaseous hydrogen feed 100.

In the embodiment depicted in FIG. 1B, at least a portion of stream 147 may be divided to form stream 148 and expanded across one or more stages of expansion. FIG. 1B shows an embodiment in which three stages of expansion are used in warm expander 24, intermediate-temperature expander 25, and cold expander 26. Stream 148 may be cooled in the cold heat exchanger 4 after the warm expander 24 and the intermediate-temperature expander 25, and may be heated in the cold heat exchanger 4 after the cold expander 26. The one or more stages of expander may be used to produce work as turbines, which can be used to generate electrical power and/or mechanically drive compressors in the process. After the one or more stages of expansion, a first cold medium-pressure hydrogen stream 153 at a pressure between 4 and 16 bar, or between 6 and 12 bar, is warmed in the cold heat exchanger 4 to form partially reheated medium-pressure hydrogen stream 141 which is returned to the warm end of the hydrogen liquefier as shown in the embodiment depicted FIG. 1A where it is warmed in warm heat exchanger 1 to form warmed medium-pressure hydrogen stream 142. The warmed medium-pressure hydrogen stream 142 is then compressed in medium-pressure compressor 21.

In the embodiment depicted in FIG. 1B, at least a portion of stream 147 is divided and cooled in cold heat exchanger 4 to form stream 154. Stream 154 may be then reduced in pressure across valve 27 to form cold recycle stream 155 which may be combined with cold hydrogen stream 111. In at least some aspects, the cold recycle stream 155 may be combined with para-hydrogen-enriched cold hydrogen stream 112 if there is no concern that para-hydrogen has converted back to ortho-hydrogen in the warm end of the hydrogen liquefier, for example in the low-pressure compressor 17, the intermediate-pressure compressor 19, and the medium-pressure compressor 21.

The warm heat exchanger 1 and cold heat exchanger 4 may be integrated into a single heat exchanger or further subdivided into smaller heat exchangers as dictated by lower capital cost in the former case or ease of operation in the latter.

The hydrogen refrigeration circuit acts as an open loop that acts with a hydrogen working fluid that is greater than 85% para-hydrogen, or greater than 90% para-hydrogen, or greater than 95% para-hydrogen. Operating the hydrogen refrigeration circuit with nearly pure para-hydrogen has the advantage that boiloff vapor 122, which is nearly pure para-hydrogen, from the storage tank 14 and/or tankers being loaded can be returned and recompressed in the low-pressure compressor 17. The present disclosure may also be applied to other cold hydrogen refrigeration systems, for example those with a closed refrigerant or open loop systems in which normal hydrogen is recycled and expanded.

The second cold hydrogen fraction 139 is reduced to a pressure between 4 and 16 bar, or between 6 and 12 bar, across valve 10 to form a second cold medium-pressure hydrogen stream 140. The second cold medium-pressure hydrogen stream 140 is warmed first in cold heat exchanger 4 and then warm heat exchanger 1, either in a separate path from the first cold medium-pressure hydrogen stream 153 or after being combined with the first cold medium-pressure hydrogen stream 153 before, after, or inside the cold heat exchanger 4 and/or the warm heat exchanger 1. If kept separate from the first cold medium-pressure hydrogen stream 153, the warmed second medium-pressure hydrogen stream 140 may also be compressed in the medium-pressure compressor 21.

FIG. 10 shows an alternative embodiment of FIG. 1B in which at least a portion of the intermediate-pressure hydrogen liquid stream 116 is divided to form stream 117. At least a portion of stream 117 is reduced to a pressure between 0.7 and 2 bar, or between 0.7 and 1.5 bar, to form a partially vaporized low-pressure hydrogen stream 124 which in turn is warmed in cold heat exchanger 4. At least a portion of stream 117 is divided to form low-pressure hydrogen liquid stream 119 which is then reduced in pressure and sent to a storage tank 14 where a liquid hydrogen product 121 can be withdrawn. Stream 117 may also be subcooled in cold heat exchanger 4 before being reduced in pressure (not shown). This arrangement may have more pressure available to transfer liquid to storage and avoids the installation of a low pressure separator, however the amount of boiloff vapor 122 from storage may be increased by the increased flash vapor from the feed.

Figure 1D:
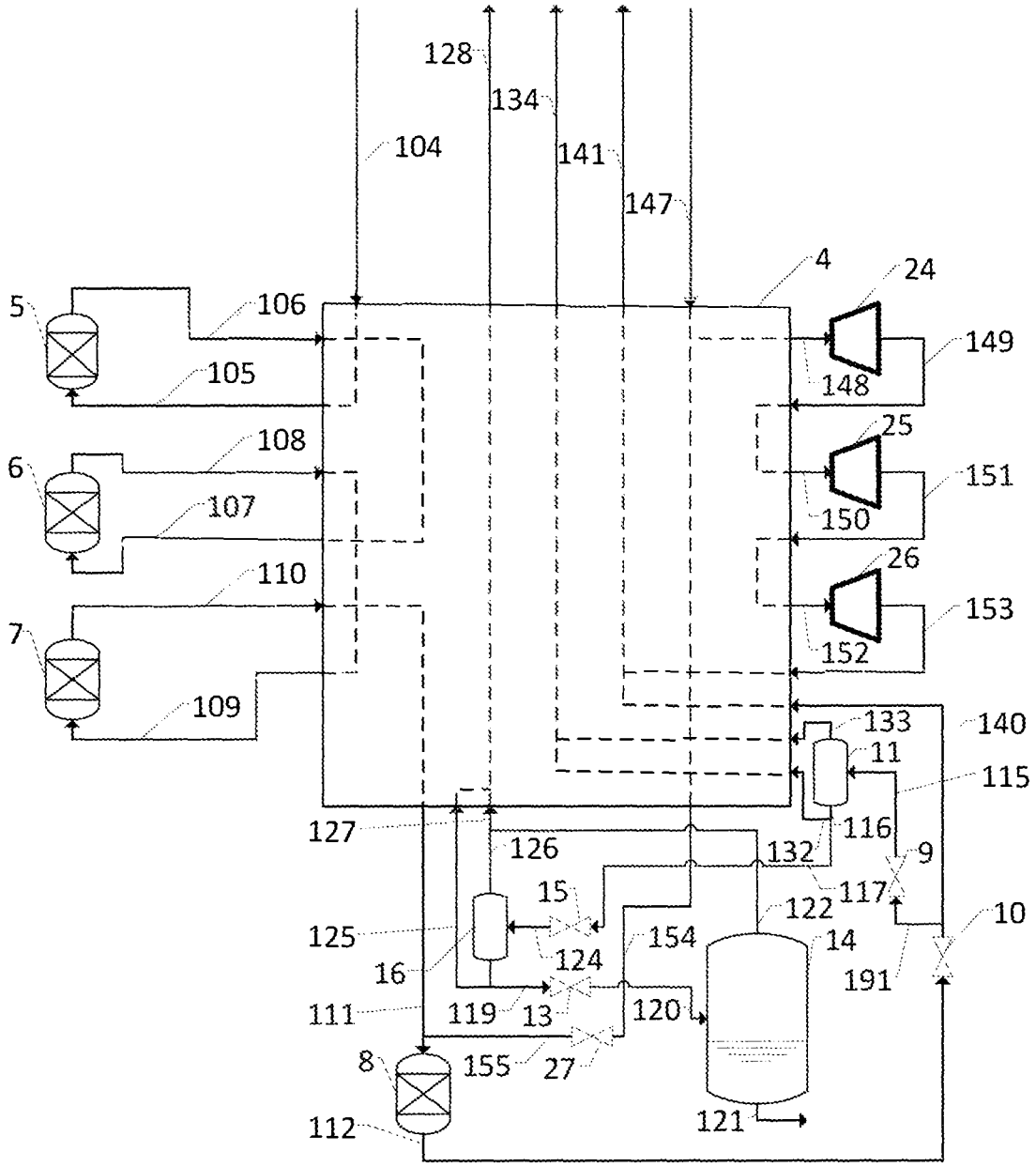
FIG. 1D is a flowsheet depicting a modification of the embodiment in FIG. 1B in which the intermediate pressure stream is divided after the cold hydrogen stream is reduced in pressure, according to an additional example embodiment of the present disclosure.

FIG. 1D shows an alternative embodiment of FIG. 1B in which the para-hydrogen-enriched cold hydrogen stream 112 is first reduced in pressure to about 10 bar before being divided into two or more fractions. In the embodiment depicted in FIG. 1D, para-hydrogen-enriched cold hydrogen stream 112 is reduced in pressure and then divided into first cold medium-pressure hydrogen stream 191 and second cold medium-pressure hydrogen stream 140. This arrangement provides an alternative control valve configuration to the embodiment depicted in FIG. 1B.

Figure 1E:
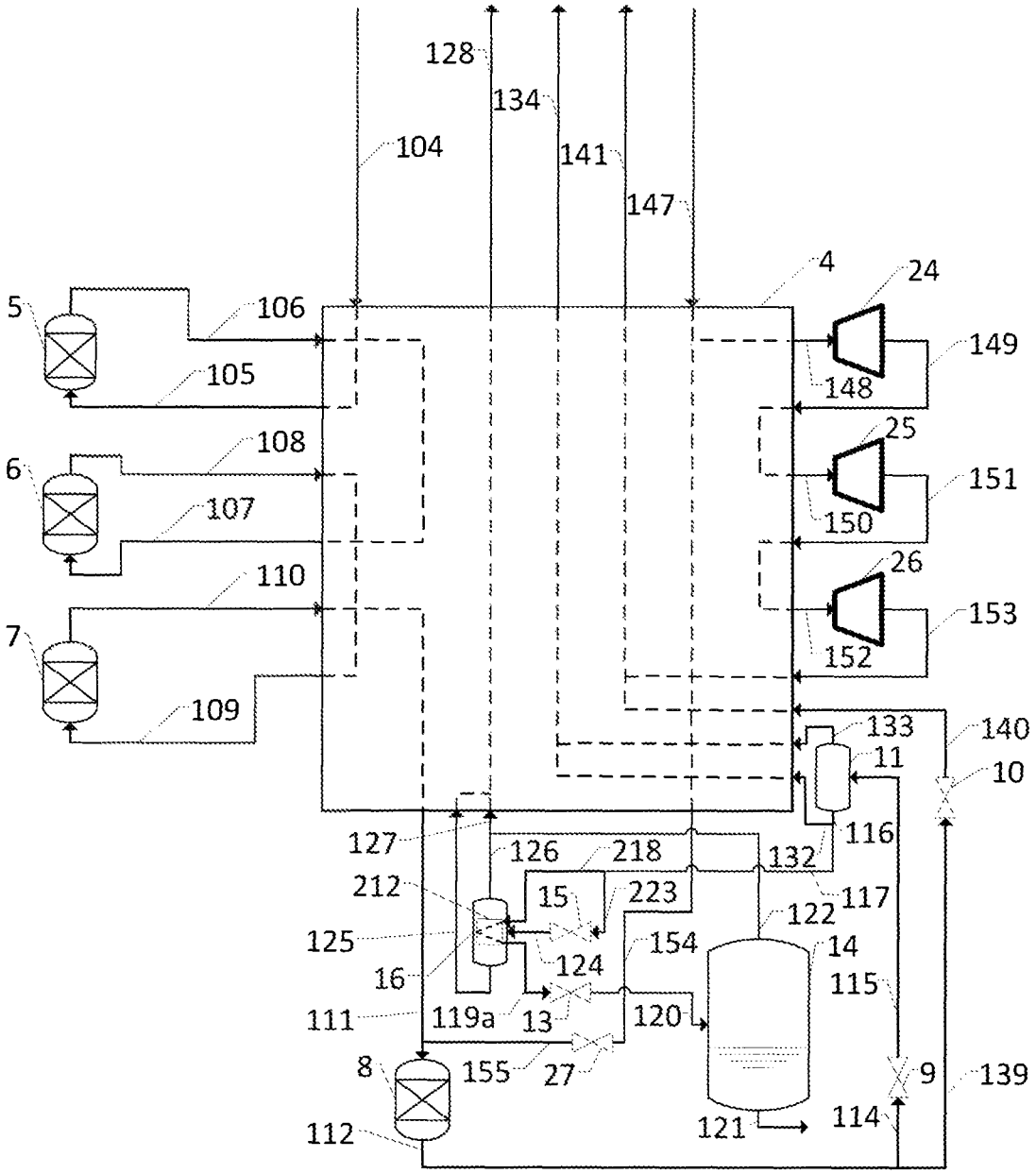
FIG. 1E is a flowsheet depicting a modification of the embodiment in FIG. 1B in which intermediate pressure liquid is subcooled against evaporating low-pressure liquid prior to storage, according to an additional example embodiment of the present disclosure.

FIG. 1E shows an alternative embodiment of FIG. 1B in which the intermediate-pressure liquid hydrogen stream 117 is divided into first intermediate-pressure liquid fraction 223 and second intermediate-pressure liquid fraction 218. The first intermediate-pressure liquid fraction 223 is reduced to a pressure between 0.7 and 2 bar, or between 0.7 and 1.5 bar, across valve 15 as in the embodiment depicted in FIG. 1B. The second intermediate-pressure liquid fraction 218 is cooled in a subcooler 212 within the low-pressure separator 16 against boiling low-pressure liquid hydrogen to form a subcooled liquid hydrogen product 119*a* which is reduced in pressure across valve 13 and fed to storage tank 14. The subcooled liquid hydrogen product 119*a* is at a higher pressure than the liquid hydrogen storage tank 14 in the embodiment depicted in FIG. 1B, which may facilitate transfer to a storage tank located at a greater elevation and/or a greater distance with respect to the rest of the process.

Figure 1F:
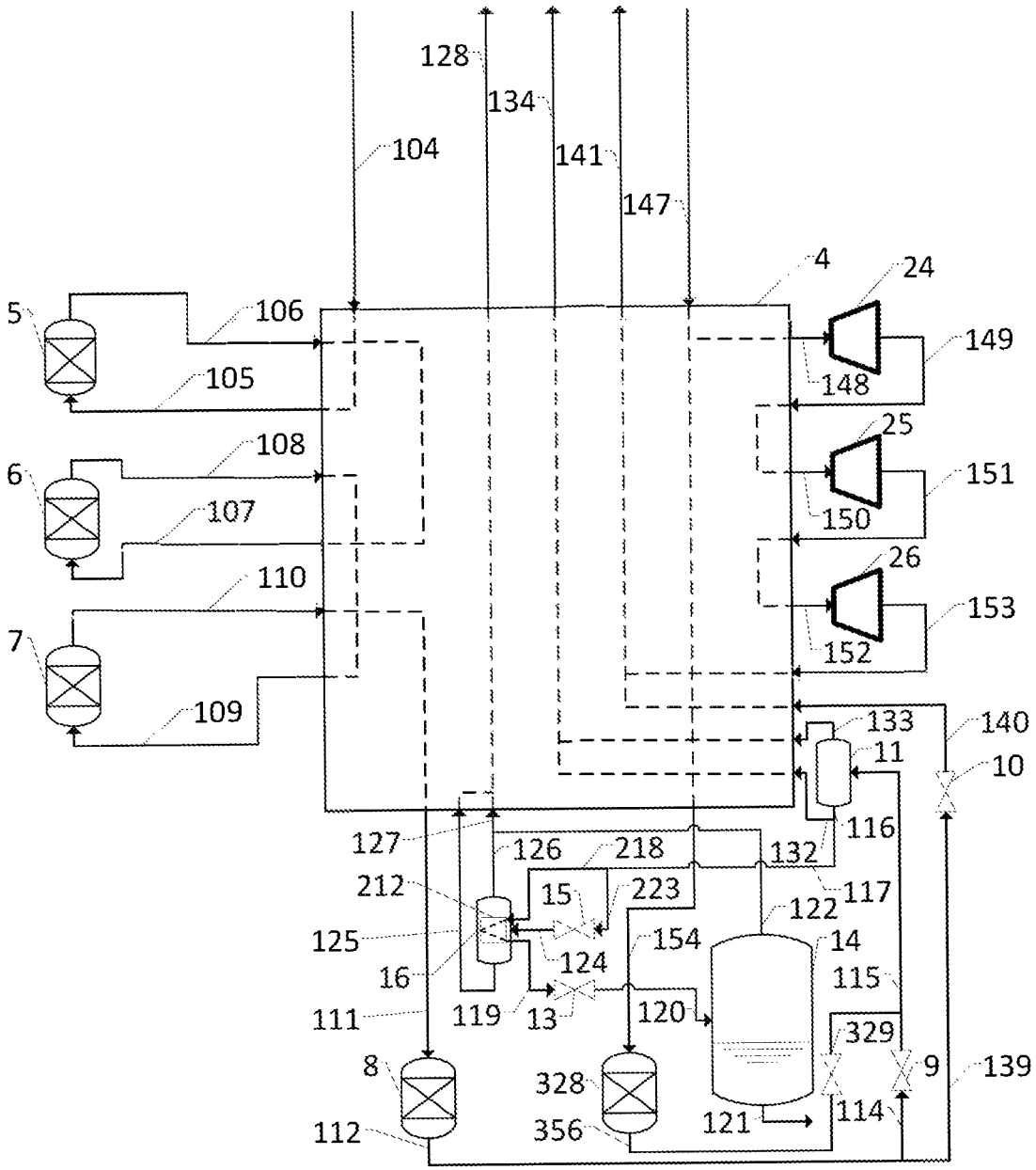
FIG. 1F is a flowsheet depicting a modification of the embodiment in FIG. 1E in which the cooled, recycled hydrogen passes through a separate ortho-para conversion reactor prior to mixing with the converted feed hydrogen, according to an additional example embodiment of the present disclosure.

FIG. 1F shows an alternative embodiment of FIG. 1E in which the cold recycle stream 155 is reacted in a second cold ortho-para conversion reactor 328 to form a para-hydrogen-enriched cold recycle stream 356. The para-hydrogen-enriched cold recycle stream is reduced in pressure across valve 329 and combined with the partially vaporized intermediate-pressure hydrogen stream 115. This arrangement has the advantage that the pressure of the gaseous hydrogen feed 100 and the recycle stream 145 may be varied independently more easily.

Figure 2A:
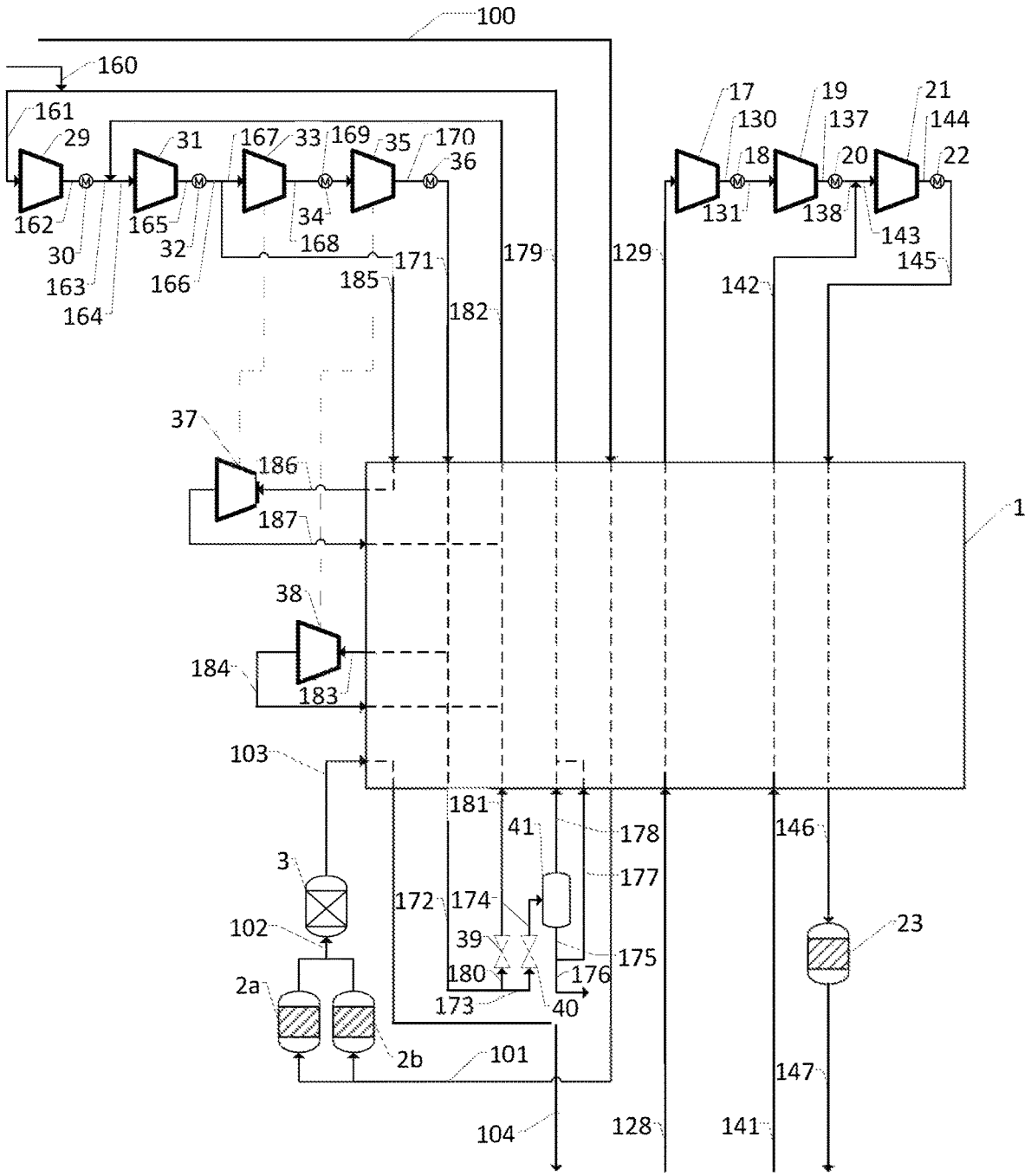
FIG. 2A is a flowsheet depicting a modification of the embodiment in FIG. 1A in which the intermediate pressure loop is eliminated, according to an additional example embodiment of the present disclosure.

The intermediate-pressure hydrogen loop present in the embodiments shown in FIGS. 1A-1F may be eliminated to simplify the process. The warm end of a hydrogen liquefier process without an intermediate-pressure hydrogen loop is shown in an additional embodiment depicted in FIG. 2A. The nitrogen refrigeration loop, hydrogen cooling, and purification steps may be similar to the embodiment depicted in FIG. 1A. A partially reheated low-pressure hydrogen stream 128 is heated in warm heat exchanger 1 to produce a warmed low-pressure hydrogen stream 129 which is then compressed in a low-pressure compressor 17 to form stream 130 which then may be cooled in interstage cooler 18 to form stream 131. Stream 131 is then compressed in an intermediate-pressure compressor 19 to form stream 137 which then may be cooled in interstage cooler 20 to form stream 138. A partially reheated medium-pressure hydrogen stream 141 is heated in warm heat exchanger 1 to produce a warmed medium-pressure hydrogen stream 142 which may then be combined with stream 138 to produce stream 143. Stream 143 is compressed in a medium-pressure compressor 21 to form stream 144 which then may be cooled in aftercooler 22 to form a recycle stream 145 at a pressure between 25 and 100 bar, or between 30 and 65 bar. The low-pressure compressor 17, the intermediate-pressure compressor 19, and the medium-pressure compressor 21 may be separate machines or combined into a single multiple stage machine. The example embodiment shown in FIG. 2A depicts intermediate-pressure compressors 17 and 19 as separate machines. The recycle stream 145 is then cooled in warm heat exchanger 1 to form cooled recycle stream 146 which then may be purified in a guard adsorber bed 23 to form stream 147, which then returns to the cold end of the hydrogen liquefier.

Figure 2B:
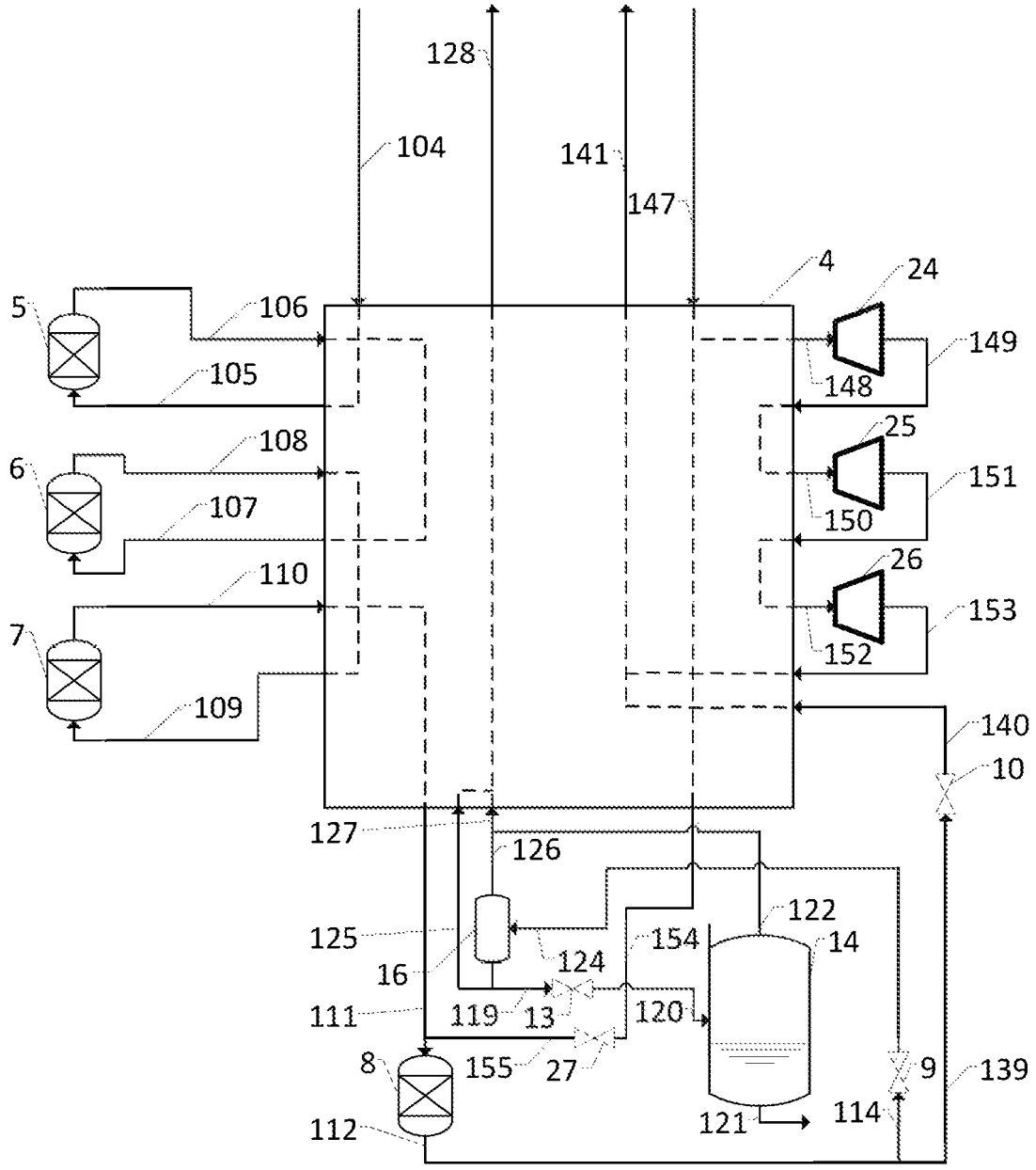
FIG. 2B is a flowsheet depicting a modification of the embodiment in FIG. 1B in which the intermediate pressure loop is eliminated, according to an additional example embodiment of the present disclosure.

The embodiment depicted in FIG. 2B shows a cold end of a hydrogen liquefier process with a low-pressure and a medium-pressure loop. The process differs from the embodiment depicted in FIG. 1B in that the first cold hydrogen fraction 114 is let down in pressure to between 0.7 and 2 bar, or between 0.7 and 1.5 bar to form a partially vaporized low-pressure hydrogen stream 124. The partially vaporized low-pressure hydrogen stream 124 may be separated into a low-pressure hydrogen vapor stream 126 and a low-pressure hydrogen liquid stream 119 in low-pressure separator 16 as in the embodiment shown in FIG. 2B, or may be divided into a liquid product portion and a portion that is returned directly to the cold heat exchanger 4 as in the embodiment shown in FIG. 10.

Figure 2C:
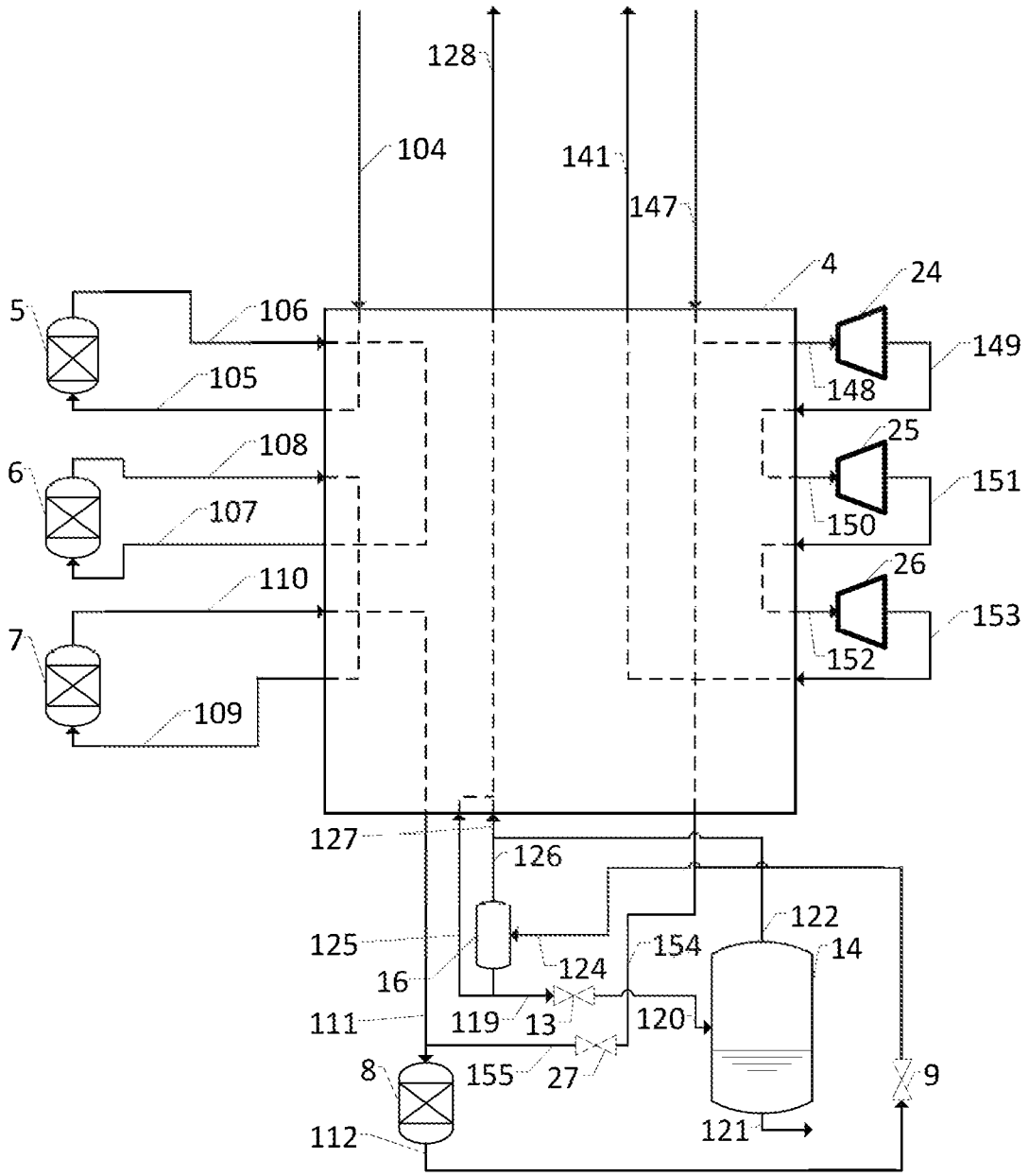
FIG. 2C is a flowsheet depicting a modification of the embodiment in FIG. 1B in which the intermediate and medium pressure loops are eliminated, according to an additional example embodiment of the present disclosure.

The embodiment depicted in FIG. 2C shows the cold end of a hydrogen liquefier process with only a low-pressure loop. The para-hydrogen-enriched cold hydrogen stream 112 is not divided; rather the entire stream is let down in pressure to between 0.7 and 2 bar, or between 0.7 and 1.5 bar to form a partially vaporized low-pressure hydrogen stream 124. The partially vaporized low-pressure hydrogen stream 124 may be separated into a low-pressure hydrogen vapor stream 126 and a low-pressure hydrogen liquid stream 119 in low-pressure separator 16 as in the embodiment shown in FIG. 2C, or may be divided into a liquid product portion and a portion that is returned directly to the cold heat exchanger 4 as in the embodiment shown in FIG. 10.

Other embodiments of the present disclosure (not illustrated) may include hydrogen liquefiers in which any of the following may be boiled in a thermosyphon arrangement with an associated separator rather than in a once-through configuration as illustrated in the embodiment shown in FIG. 1B: the second cold medium-pressure hydrogen stream 140, the intermediate-pressure hydrogen liquid stream 132, and/or the low-pressure liquid hydrogen return stream 125.

Example 1

A computer simulation of the embodiment for the process depicted in FIGS. 1A and 1B was carried out using Aspen Plus™, a commercial process simulation software package available from Aspen Technology, Inc. The feed stream was pure hydrogen at 305 K and 31 bar at the ambient equilibrium concentration of 75% ortho-hydrogen and 25% para-hydrogen. Key stream parameters such as composition, pressure, temperature, and flow rate are shown in Table 1, along with total power consumption.

Subcooling the cold hydrogen stream 111 at high pressure allows the para-hydrogen-enriched cold hydrogen stream 112 to remain in the liquid phase after the exothermic ortho-hydrogen to para-hydrogen reaction is completed. The subsequent flashing in stages allows more vapor to be recycled at higher pressures, lowering power demands and reducing the physical size of the low-pressure compressor 17.

TABLE 1

| | | Stream number | | | | | | | |
|---|---|---|---|---|---|---|---|---|---|
| | | 100 | 112 | 116 | 121 | 133 | 140 | 145 | 154 |
| Temperature | K | 305.0 | 27.8 | 25.6 | 21.4 | 25.6 | 28.2 | 305.0 | 24.4 |
| Pressure | bar | 31.00 | 28.97 | 3.69 | 1.38 | 3.69 | 9.17 | 34.68 | 34.05 |
| Molar Flow | kmol/hr | 496.0 | 1005.9 | 720.0 | 496.0 | 87.0 | 198.9 | 3454.6 | 509.8 |
| Mass Flow | kg/hr | 1000.0 | 2027.8 | 1451.4 | 999.9 | 175.3 | 401.1 | 6964.4 | 1027.8 |
| Vapour Fraction | | 1.00 | 0.00 | 0.00 | 0.00 | 1.00 | 0.00 | 1.00 | 0.00 |
| Mole fraction ortho-H2 | | 0.750 | 0.025 | 0.025 | 0.025 | 0.025 | 0.025 | 0.025 | 0.025 |
| Mole fraction para-H2 | | 0.250 | 0.975 | 0.975 | 0.975 | 0.975 | 0.975 | 0.975 | 0.975 |
| Mole fraction nitrogen | | 0.000 | 0.000 | 0.000 | 0.000 | 0.000 | 0.000 | 0.000 | 0.000 |

| | | Stream number | | | | | | |
|---|---|---|---|---|---|---|---|---|
| | | 161 | 171 | 172 | 174 | 181 | 183 | 186 |
| Temperature | K | 302.1 | 305.0 | 79.7 | 78.7 | 81.5 | 183.8 | 254.8 |
| Pressure | bar | 1.06 | 64.12 | 63.84 | 1.20 | 10.31 | 63.84 | 30.53 |
| Molar Flow | kmol/hr | 142.9 | 1402.3 | 222.3 | 142.9 | 79.4 | 1180.1 | 1158.8 |
| Mass Flow | kg/hr | 4002.2 | 39284.6 | 6226.3 | 4002.2 | 2224.1 | 33058.3 | 32461.9 |
| Vapour Fraction | | 1.00 | 1.00 | 0.00 | 0.08 | 0.00 | 1.00 | 1.00 |
| Mole fraction ortho-H2 | | 0.0000 | 0.0000 | 0.0000 | 0.0000 | 0.0000 | 0.0000 | 0.0000 |
| Mole fraction para-H2 | | 0.0000 | 0.0000 | 0.0000 | 0.0000 | 0.0000 | 0.0000 | 0.0000 |
| Mole fraction nitrogen | | 1.0000 | 1.0000 | 1.0000 | 1.0000 | 1.0000 | 1.0000 | 1.0000 |
| Compressors 29, 31, 33, 35 | 3256 | kW | | | | | | |
| Compressors 17, 19, 21 | 6184 | kW | | | | | | |
| Total power | 9440 | kW | | | | | | |

Example 2

The advantages of the intermediate-pressure loop can be best illustrated by comparing to embodiments of the present disclosure lacking the loop. A computer simulation of the process of FIGS. 2A and 2B was carried out using Aspen Plus™. The feed stream was pure hydrogen at 305 K and 31 bar at the ambient equilibrium concentration of 75% ortho-hydrogen and 25% para-hydrogen. Key stream parameters such as composition, pressure, temperature, and flow rate are shown in Table 2 along with total power consumption. Comparison with Example 1 shows that the removal of the intermediate-pressure loop results in a 2.5% increase in power consumption.

TABLE 2

| | | Stream number | | | | | |
|---|---|---|---|---|---|---|---|
| | | 100 | 112 | 121 | 140 | 145 | 154 |
| Temperature | K | 305.0 | 27.8 | 21.4 | 28.2 | 305.0 | 24.5 |
| Pressure | bar | 31.00 | 28.97 | 1.38 | 8.54 | 33.58 | 32.95 |
| Molar Flow | kmol/hr | 496.0 | 978.6 | 496.0 | 192.5 | 3376.0 | 482.6 |
| Mass Flow | kg/hr | 1000.0 | 1972.8 | 1000.0 | 388.2 | 6806.0 | 972.8 |
| Vapour Fraction | | 1.00 | 0.00 | 0.00 | 0.00 | 1.00 | 0.00 |
| Mole fraction ortho-H2 | | 0.7500 | 0.0250 | 0.0250 | 0.0250 | 0.0250 | 0.0250 |
| Mole fraction para-H2 | | 0.2500 | 0.9750 | 0.9750 | 0.9750 | 0.9750 | 0.9750 |
| Mole fraction nitrogen | | 0.0000 | 0.0000 | 0.0000 | 0.0000 | 0.0000 | 0.0000 |

| | | Stream number | | | | | | |
|---|---|---|---|---|---|---|---|---|
| | | 161 | 171 | 172 | 174 | 181 | 183 | 186 |
| Temperature | K | 302.2 | 305.0 | 79.7 | 78.7 | 81.6 | 183.5 | 256.6 |
| Pressure | bar | 1.06 | 64.64 | 64.36 | 1.20 | 10.14 | 64.36 | 30.44 |
| Molar Flow | kmol/hr | 139.3 | 1367.7 | 216.3 | 139.3 | 77.1 | 1151.4 | 1140.1 |
| Mass Flow | kg/hr | 3901.3 | 38314.6 | 6060.1 | 3901.3 | 2158.8 | 32254.5 | 31938.5 |
| Vapour Fraction | | 1.00 | 1.00 | 0.00 | 0.08 | 0.00 | 1.00 | 1.00 |
| Mole fraction ortho-H2 | | 0.0000 | 0.0000 | 0.0000 | 0.0000 | 0.0000 | 0.0000 | 0.0000 |
| Mole fraction para-H2 | | 0.0000 | 0.0000 | 0.0000 | 0.0000 | 0.0000 | 0.0000 | 0.0000 |
| Mole fraction nitrogen | | 1.0000 | 1.0000 | 1.0000 | 1.0000 | 1.0000 | 1.0000 | 1.0000 |
| Compressors 29, 31, 33, 35 | 3222 | kW | | | | | | |
| Compressors 17, 19, 21 | 6456 | kW | | | | | | |
| Total power | 9678 | kW | | | | | | |

Example 3

The simplest cycle with only a low-pressure loop was also modeled. A computer simulation of the embodiment depicted in FIGS. 2A and 2C was carried out using Aspen Plus™. The feed stream was pure hydrogen at 305 K and 31 bar at the ambient equilibrium concentration of 75% ortho-hydrogen and 25% para-hydrogen. Key stream parameters such as composition, pressure, temperature, and flow rate are shown in Table 2 along with total power consumption. Comparison with Example 1 shows that the removal of the intermediate-pressure and medium-pressure loops results in a 4.7% increase in power consumption.

TABLE 3

| | | Stream number | | | | |
|---|---|---|---|---|---|---|
| | | 100 | 112 | 121 | 145 | 154 |
| Temperature | K | 305.0 | 27.8 | 21.4 | 305.0 | 24.2 |
| Pressure | bar | 31.00 | 28.97 | 1.38 | 32.98 | 32.35 |
| Molar Flow | kmol/hr | 496.0 | 856.1 | 496.1 | 3244.4 | 360.1 |
| Mass Flow | kg/hr | 1000.0 | 1725.9 | 1000.0 | 6540.7 | 725.9 |
| Vapour Fraction | | 1.00 | 0.00 | 0.00 | 1.00 | 0.00 |
| Mole fraction ortho-H2 | | 0.7500 | 0.0250 | 0.0250 | 0.0250 | 0.0250 |
| Mole fraction para-H2 | | 0.2500 | 0.9750 | 0.9750 | 0.9750 | 0.9750 |
| Mole fraction nitrogen | | 0.0000 | 0.0000 | 0.0000 | 0.0000 | 0.0000 |

| | | Stream number | | | | | | |
|---|---|---|---|---|---|---|---|---|
| | | 161 | 171 | 172 | 174 | 181 | 183 | 186 |
| Temperature | K | 302.3 | 305.0 | 79.7 | 78.8 | 81.6 | 183.4 | 256.5 |
| Pressure | bar | 1.06 | 65.32 | 65.04 | 1.20 | 10.23 | 65.04 | 30.57 |
| Molar Flow | kmol/hr | 139.5 | 1340.3 | 209.2 | 139.5 | 69.7 | 1131.1 | 1144.3 |
| Mass Flow | kg/hr | 3907.0 | 37546.4 | 5860.4 | 3907.0 | 1953.3 | 31686.1 | 32056.8 |
| Vapour Fraction | | 1.00 | 1.00 | 0.00 | 0.08 | 0.00 | 1.00 | 1.00 |
| Mole fraction ortho-H2 | | 0.0000 | 0.0000 | 0.0000 | 0.0000 | 0.0000 | 0.0000 | 0.0000 |
| Mole fraction para-H2 | | 0.0000 | 0.0000 | 0.0000 | 0.0000 | 0.0000 | 0.0000 | 0.0000 |
| Mole fraction nitrogen | | 1.0000 | 1.0000 | 1.0000 | 1.0000 | 1.0000 | 1.0000 | 1.0000 |
| Compressors 29, 31, 33, 35 | 3185 | kW | | | | | | |
| Compressors 17,19, 21 | 6700 | kW | | | | | | |
| Total power | 9885 | kW | | | | | | |

While the principles of the disclosure have been described above in connection with preferred embodiments, it is to be clearly understood that this description is made only by way of example and not as a limitation of the scope of the invention.

The invention claimed is:

1. A process for liquefying hydrogen, the process comprising:

cooling a hydrogen feed comprising ortho-hydrogen and para-hydrogen by indirect heat exchange to form a cold hydrogen stream;

expanding at least a portion of the cold hydrogen stream to produce a partially vaporized intermediate-pressure hydrogen stream;

separating the partially vaporized intermediate-pressure hydrogen stream to produce an intermediate-pressure hydrogen vapor stream and an intermediate-pressure hydrogen liquid stream;

expanding at least a portion of the intermediate-pressure hydrogen liquid stream to produce a partially vaporized low-pressure hydrogen stream;

warming by indirect heat exchange the partially vaporized low-pressure hydrogen stream or a stream derived from the partially vaporized low-pressure hydrogen stream to produce a warmed low-pressure hydrogen stream;

warming by indirect heat exchange the intermediate-pressure hydrogen vapor stream to produce a warmed intermediate-pressure hydrogen stream;

compressing and combining the warmed low-pressure hydrogen stream, the warmed intermediate-pressure hydrogen stream, and a warmed medium-pressure hydrogen stream to produce a recycle stream;

cooling by indirect heat exchange the recycle stream to produce a cooled recycle stream;

expanding at least a portion of the cooled recycle stream to produce a first cold medium-pressure hydrogen stream; and warming by indirect heat exchange the first cold medium-pressure hydrogen stream to produce the warmed medium-pressure hydrogen stream;

wherein a cooling duty for cooling the hydrogen feed by indirect heat exchange is provided at least in part by the intermediate-pressure hydrogen vapor stream;

wherein the warmed intermediate-pressure hydrogen stream is compressed prior to combining with the warmed medium-pressure hydrogen stream.

2. The process of claim 1, further comprising catalytically converting at least a portion of the ortho-hydrogen into para-hydrogen in the cold hydrogen stream.

3. The process of claim 2, wherein a pressure of the cold hydrogen stream is above the critical pressure and a temperature of the cold hydrogen stream is below the critical temperature.

4. The process of claim 1, further comprising warming by indirect heat exchange at least a portion of the intermediate-pressure hydrogen liquid stream to produce a second warmed intermediate-pressure hydrogen stream; and compressing and combining the second warmed intermediate-pressure hydrogen stream with the warmed low-pressure hydrogen stream, the warmed intermediate-pressure hydrogen stream, and the warmed medium-pressure hydrogen stream to produce the recycle stream.

5. The process of claim 1, further comprising dividing a portion of the intermediate-pressure hydrogen vapor stream and/or the warmed intermediate-pressure hydrogen stream to produce a purge gas stream;

wherein the hydrogen feed and the purge gas stream comprise one or more light gases selected from a group consisting of helium and neon; and wherein the purge gas stream is enriched in the light gases relative to the hydrogen feed.

6. The process of claim 1, further comprising catalytically converting at least a portion of the ortho-hydrogen into para-hydrogen in the cooled recycle stream.

7. The process of claim 1, further comprising expanding at least a portion of the cold hydrogen stream to produce a second medium-pressure hydrogen stream; and warming by indirect heat exchange and combining the second medium-pressure hydrogen stream and the first cold medium-pressure hydrogen stream to produce the warmed medium-pressure hydrogen stream.

8. The process of claim 1, further comprising expanding at least a portion of the cooled recycle stream to produce a cold recycle stream; and combining the cold recycle stream with the cold hydrogen stream.

9. The process of claim 1, wherein the recycle stream comprises more than 90% para-hydrogen by volume.

10. The process of claim 1, further comprising the following steps:

compressing at least a portion of a nitrogen stream by one or more stages of compression to produce a compressed nitrogen stream;

cooling by indirect heat exchange the compressed nitrogen stream to produce a cooled compressed nitrogen stream;

expanding at least a portion of the cooled compressed nitrogen stream to produce a partially condensed nitrogen stream;

separating the partially condensed nitrogen stream to produce a nitrogen vapor stream and a nitrogen liquid stream; and warming by indirect heat exchange and combining the nitrogen vapor stream and at least a portion of the nitrogen liquid stream to produce a nitrogen return stream;

wherein the nitrogen stream comprises the nitrogen return stream;

wherein the cooling duty for cooling the hydrogen feed by indirect heat exchange is provided at least in part by the nitrogen vapor stream and the at least the portion of the nitrogen liquid stream.

11. The process of claim 10, further comprising dividing at least a portion of the nitrogen liquid stream to produce a liquid nitrogen product.

12. The process of claim 10, further comprising the following steps:

cooling by indirect heat exchange and dividing a portion of the compressed nitrogen stream to produce a cold nitrogen expander feed;

expanding the cold nitrogen expander feed to produce a first cold medium-pressure nitrogen stream;

warming by indirect heat exchange the first cold medium-pressure nitrogen stream to produce a first medium-pressure nitrogen stream; and feeding a medium-pressure nitrogen recycle stream to an interstage of the one or more stages of compression;

wherein the medium-pressure nitrogen recycle stream comprises the first medium-pressure nitrogen stream.

13. The process of claim 12, further comprising the following steps:

extracting a portion of the nitrogen stream from an interstage of the one or more stages of compression to produce a warm nitrogen expander feed;

expanding the warm nitrogen expander feed to produce a second cold medium-pressure nitrogen stream; and warming by indirect heat exchange the second cold medium-pressure nitrogen stream to produce a second medium-pressure nitrogen recycle stream;

wherein the medium-pressure nitrogen recycle stream comprises the second medium-pressure nitrogen recycle stream.

14. The process of claim 13, further comprising the following steps:

expanding at least a portion of the cooled compressed nitrogen stream to produce a third cold medium-pressure nitrogen stream;

warming by indirect heat exchange the third cold medium-pressure nitrogen stream to produce a third medium-pressure nitrogen recycle stream;

wherein the medium-pressure nitrogen recycle stream comprises the third medium-pressure nitrogen recycle stream.

15. The process of claim 1, further comprising:

separating the partially vaporized low-pressure hydrogen stream to produce a low-pressure hydrogen vapor stream and a low-pressure hydrogen liquid stream;

dividing at least a portion of the low-pressure hydrogen liquid stream to form a low-pressure hydrogen return stream;

warming by indirect heat exchange and combining the low-pressure hydrogen return stream with the low-pressure hydrogen vapor stream to produce the warmed low-pressure hydrogen stream.

16. The process of claim 1, further comprising catalytically converting at least a portion of the ortho-hydrogen into para-hydrogen in the hydrogen feed.

* * * * *